United States Patent [19]

Moore

[11] Patent Number: 4,580,484

[45] Date of Patent: Apr. 8, 1986

[54] FIREARM AND FIREARM CONVERSION UNIT

[76] Inventor: Wildey J. Moore, P.O. Box 4046, New Windsor, N.Y. 12550

[21] Appl. No.: 600,113

[22] Filed: Apr. 13, 1984

[51] Int. Cl.[4] ..... F41D 5/08; F41C 11/06

[52] U.S. Cl. ..... 89/128; 89/187.02; 89/191.01; 42/77

[58] Field of Search ..... 89/128, 173, 187.02, 89/191.01, 193, 29; 42/77

[56] References Cited

U.S. PATENT DOCUMENTS

| | | | |
|---|---|---|---|
| 1,176,873 | 3/1916 | Swebilius et al. | 89/191.01 X |
| 1,563,675 | 12/1925 | Tansley | 89/128 |
| 2,468,784 | 5/1949 | Seagraves | 89/191.01 X |
| 2,487,198 | 11/1949 | Swebilus | 89/191.01 |
| 2,581,395 | 1/1952 | Elfstrom | 89/191.01 X |
| 3,069,976 | 12/1962 | Stevens | 89/191.01 X |
| 3,306,168 | 2/1967 | Blumrick | 89/191.01 |
| 3,504,594 | 4/1970 | Greeley | 42/77 X |
| 3,724,326 | 4/1973 | Day | 42/77 X |
| 4,213,261 | 7/1980 | Claypool | 89/187.02 X |
| 4,373,423 | 2/1983 | Moore | 89/193 X |

FOREIGN PATENT DOCUMENTS

| | | | |
|---|---|---|---|
| 11357 | 10/1956 | Fed. Rep. of Germany | 89/187.02 |
| 2822914 | 11/1979 | Fed. Rep. of Germany | 89/187.02 |
| 588951 | 2/1925 | France | 89/191 |

*Primary Examiner*—David H. Brown

*Attorney, Agent, or Firm*—McCormick, Paulding & Huber

[57] ABSTRACT

A unit is disclosed for use in converting a blowback autoloading pistol, such as a U.S. caliber .45 model 1911, into a gas operated one with the unit being adapted for connection to the receiver of the blowback pistol after its barrel and slide are removed. The unit comprises a shroud, a barrel and a gas activated piston for operating the bolt and its lock. The hammer, constituting part of the firing mechanism carried by the receiver, cooperates with the firing pin of the conversion unit in the same way as it did with the firing pin of the autoloading pistol. Instead of being used to effect a conversion, the structure involved in the conversion unit can also be used in making a completely new gas operated pistol or other firearm.

12 Claims, 9 Drawing Figures

PRIOR ART

FIREARM AND FIREARM CONVERSION UNIT

BACKGROUND OF THE INVENTION

This invention relates to firearms and deals more particularly with a unit for use in converting a blowback autoloading pistol into a gas operated one. It also deals with firearms, whether converted or of entirely new manufacture, using various features of the conversion unit, particularly a firearm having an improved bolt and bolt locking mechanism operated in response to the movement of a gas activated piston.

Heretofore many autoloading pistols have been of the blowback variety wherein during firing the blowback pressure exerted by the cartridge shell on the bolt is used to operate the bolt, during the course of which operation the bolt is unlocked for movement relative to the barrel, the spent shell ejected, a new cartridge brought to the firing chamber, the hammer cocked and the bolt returned to locked firing position. A very popular model of blowback autoloading pistol is the U.S. caliber .45 model 1911 pistol as made by Colt, Remington, Ithaca Gun Company and others with an estimated several million of such model pistols having been made from 1911 to date. Other autoloading pistols of generally similar design are the Browning Model P35, the Smith and Wesson Model 39, the Polish Radom and the Russian M1933 Tokarev. In all of these pistols the barrel and slide are separate parts with the barrel unlocking itself from the slide, which includes the bolt, as the slide moves to the rear in response to a firing. This design inherently causes a heavy recoil, inaccuracy because the barrel and sights are not integral and the need to change the recoil spring if loads of different operating pressures are used.

Despite the past popularity of blowback type autoloading pistols, a modern trend is toward gas operated pistols wherein a piston activated by the high pressure gases appearing in the barrel during firing operates a bolt to achieve the aforesaid functions of bolt unlocking, shell ejection, cartridge chambering, hammer cocking and bolt locking.

Since gas operated autoloading pistols are in demand a purpose of this invention is to provide such a firearm representing an improvement over those presently available or proposed. In this regard a more detailed object is to provide a smoothly operating and reliable bolt and bolt locking means for a firearm particularly well adapted for operation by a gas activated piston, which bolt and bolt locking means may be used with other types of gas piston activated firearms as well as with pistols.

Another object of the invention is to provide a conversion unit for converting an existing blowback autoloading pistol, such as U.S. .45 caliber model 1911, into a gas operated one. In keeping with this object a more detailed aim of the invention is to provide such a conversion unit which is very easily assembled with the receiver of the blowback pistol after its slide and barrel are removed.

Another object of this invention is to provide a conversion unit of the foregoing character allowing a conversion to be made without having to modify or alter, as by machining or otherwise, any part of the receiver frame or any parts carried by that frame.

A still further object of the invention is to provide a gas operated firearm either made as an entirely new article or made by converting a blowback pistol into a gas operated one through the use of a conversion unit such as described above, wherein an automatic control of the gas pressure applied to the piston is obtained thereby allowing the firearm to be used with cartridges of different load without having to change the recoil spring or make any other adjustment.

Other objects and advantages of the invention will be apparent from the following detailed description of a preferred embodiment of the invention taken in conjunction with the accompanying drawings.

In the drawings the illustrated conversion unit is one designed for connection to the receiver of a U.S. caliber .45 model 1911 autoloading pistol, however this has been done for convenience only and it should be understood that other conversion units generally similar to the one illustrated may be designed for use with other blowback pistols generally similar to the U.S. caliber .45 model 1911.

SUMMARY OF THE INVENTION

The invention resides in a unit for use in converting a blowback autoloading pistol into a gas piston operated one with the unit replacing on the receiver of the blowback pistol its original barrel and slide. The unit has a shroud, a barrel fixed to the shroud, a gas piston operated bolt, and a means for connecting the shroud to the receiver so that the shroud is immovable relative to the receiver and so that the hammer of the receiver can activate the firing pin of the bolt in substantially the same way as it did the firing pin of the original unconverted blowback pistol. In connecting the conversion unit to the receiver, use is made of the longitudinally extending grooves of the receiver originally accommodating the sliding movement of the slide so that the conversion unit may be assembled with the receiver by merely sliding it into assembled position and holding it in that position by means of the original slide stop.

The invention also resides in the construction of a bolt and locking means as used in the conversion unit, or in an entirely newly manufactured firearm, wherein the bolt is locked in its forward position by a locking member movable in a direction perpendicular to the path of movement of the bolt into and out of locked relation with respect to a frame recess with the bolt having associated with it an operating member slidable relative to the bolt parallel to the bolt path of movement, the operating member having a cam surface engageable with the locking member to hold the locking member in its locked position when the operating member is in a forward position relative to the bolt and to release the locking member for movement to the released or unlocked position when the operating member is moved to a rearward position relative to the bolt, the operating member when moved to said rearward position being in abutment with said bolt so that upon further rearward movement of the operating member relative to the frame the bolt is moved rearwardly from its closed to its open position relative to the barrel, the operating member in turn being directly connected with the piston so as to be movable in unison with it.

The invention still further resides in the gas piston of a piston operated firearm being so constructed that after a certain pressure is applied to the piston further increase in pressure is inhibited by a valving arrangement which cuts off further flow of gas to the piston after the piston starts to move.

DETAILED DESCRIPTION OF THE PREFERRED EMBODIMENTS

Figure 1:
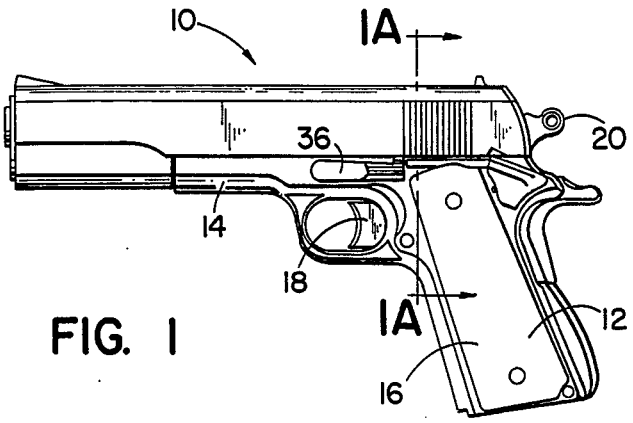
FIG. 1 PRIOR ART
FIG. 1 is a side elevational view of an existing blowback autoloading pistol of the type with which the conversion unit of this invention may be used.
Figure 1A:
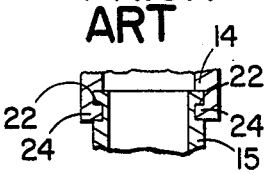
FIG. 1A PRIOR ART
FIG. 1*a* is a fragmentary sectional view taken on the line 1*a*—1*a* of FIG. 1.

As mentioned, the invention may be embodied in a unit for use in converting a blowback autoloading pistol into a gas piston operated one. By way of example, FIG. 1 illustrates an existing pistol 10 of the type for which a conversion unit embodying the invention may be designed. The pistol 10 is a U.S. caliber .45 model 1911, as made by various different manufacturers, and consists basically of a receiver 12, slide 14, and barrel 17. The receiver has a frame 15, provides a grip 16 and carries a trigger mechanism including a trigger 18 and hammer 20.

The slide 14 of the pistol 10 is supported on the receiver 12 for forward to rear sliding movement by a pair of longitudinally extending guide rails 22 on the receiver and a matching pair of guide rails 24 on the slide. The slide 14 has a bolt 26 rigidly, that is immovably, fixed to it carrying a firing pin 28 for cooperation with the hammer 20. Front and rear sights 27 and 29 are integral with the slide.

The barrel 16 is slidable and tiltable relative to the slide 14 and is connected to the receiver 12 through a link 30 pivotally connected to the barrel by a pin 32 and pivotally connected to the receiver by the pin 34 of a slide stop 36. That is, in the assembled condition of the pistol 10, as seen in FIG. 1, the pin 34 of the slide stop 36 extends through a pair of holes, only one of which is shown at 38 in FIG. 2, in the sidewalls of the receiver frame and through the opening 40 in the lower end of the link 30.

Figure 2:
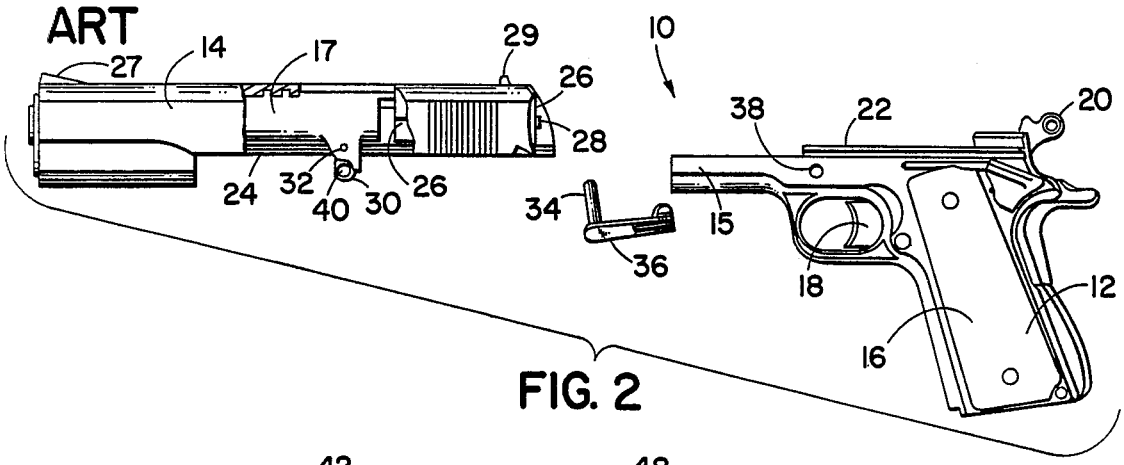
FIG. 2 is a side elevational view of the pistol of FIG. 1 but showing its slide and barrel disassembled from its receiver and with various parts of the slide being broken away to reveal the structure of other parts.

In making the conversion using the conversion unit of this invention, the pistol 10 is first disassembled to the state shown in FIG. 2, achieved essentially by removing the slide stop 36 from the receiver and sliding the slide 14 along with the barrel 17 from the receiver 12. The recoil spring, recoil spring plug and recoil spring guide (not shown in FIG. 2) are also removed from the receiver along with the slide 14.

Figure 3:
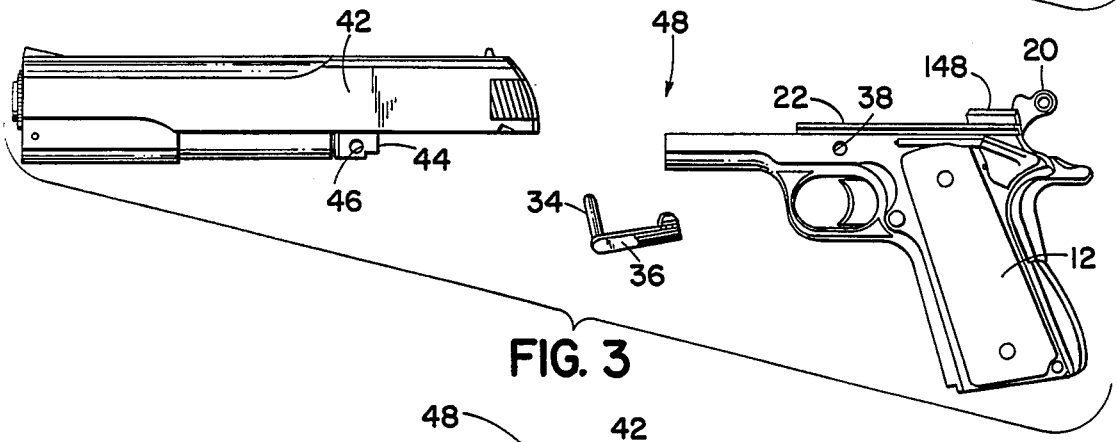
FIG. 3 is a side elevational view showing the receiver of FIG. 2 in disassembled relation with a conversion unit embodying the invention and adapted for assembly with the receiver to create a gas operated autoloading pistol.
Figure 4:
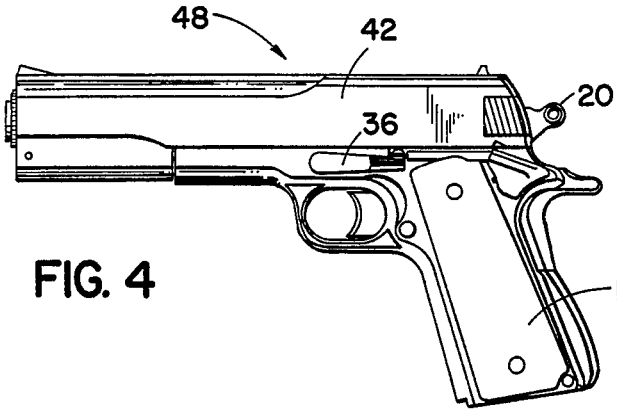
FIG. 4 is a side elevational view of an assembled gas operated pistol made from the parts of FIG. 3.

To complete the conversion, a conversion unit 42 is provided, as shown in FIG. 3, and is assembled with the receiver 12 by placing it generally as shown in FIG. 3 and then sliding it onto the receiver using the guide rails 22 of the receiver and conforming guide rails provided in the unit 42. The unit 42 includes a connecting lug 44 having a transversely extending opening 46 which registers with the openings 38 in the receiver when the conversion unit is moved to its proper assembled position on the receiver and when this position is reached the assembly is completed by inserting the pin 34 of the slide lock 36 through the openings 38 of the receiver and the opening 46 of the conversion unit to hold the receiver and the conversion unit immovable relative to one another in the assembled condition. As explained in more detail hereinafter, the conversion unit 42 has a barrel and a bolt with a firing pin and in the assembled condition of the receiver and conversion unit, as shown in FIG. 4, the firing pin of the conversion unit is positioned to be operated by the hammer 20 of the receiver in the same way as was the firing pin 28 of the original firearm so that the receiver 12 serves substantially the same purposes in the pistol, indicated generally at 48, made by the conversion as it does in the original pistol 10.

The conversion unit 42 provides the pistol 48 with a gas piston activated autoloading type of operation and reference may be made to FIGS. 5 to 8 for further understanding of its construction and operation. Turning to these figures, the major portions of the conversion unit 42 are a shroud 47, a barrel 52, a bolt 54 and a gas piston activated means, indicated generally at 56, for operating the bolt 54 and its associated locking means in response to the firing of a cartridge.

The shroud 47 is a one-piece metallic part extending along substantially the entire length of the pistol 48. The connecting lug 44 is part of the shroud 47. As seen best in FIG. 7, the shroud along its bottom portion has a pair of guide rails 58, 58 which cooperate with the guide rails 22, 22 of the receiver to restrain the conversion unit to sliding movement relative to the receiver during assembly, and the pin 34 prevents such sliding movement after assembly. Thus, the shroud and receiver frame 15 may be viewed as comprising a combined frame for the firearm. In any event, the shroud 48 does not move relative to the receiver 12 during repeated firings of the pistol 48, and in connection with this it should be noted that the shroud 47 carries both the rear sight 60 and forward sight 62 which therefore also do not move relative to the receiver or barrel during firing, thereby increasing the accuracy of sighting the pistol 48 as compared to that of the pistol 10 in which the front and rear sights 27 and 29 are carried by the slide 14 and move with the slide relative to the receiver and relative to the barrel during firing.

Figure 5:
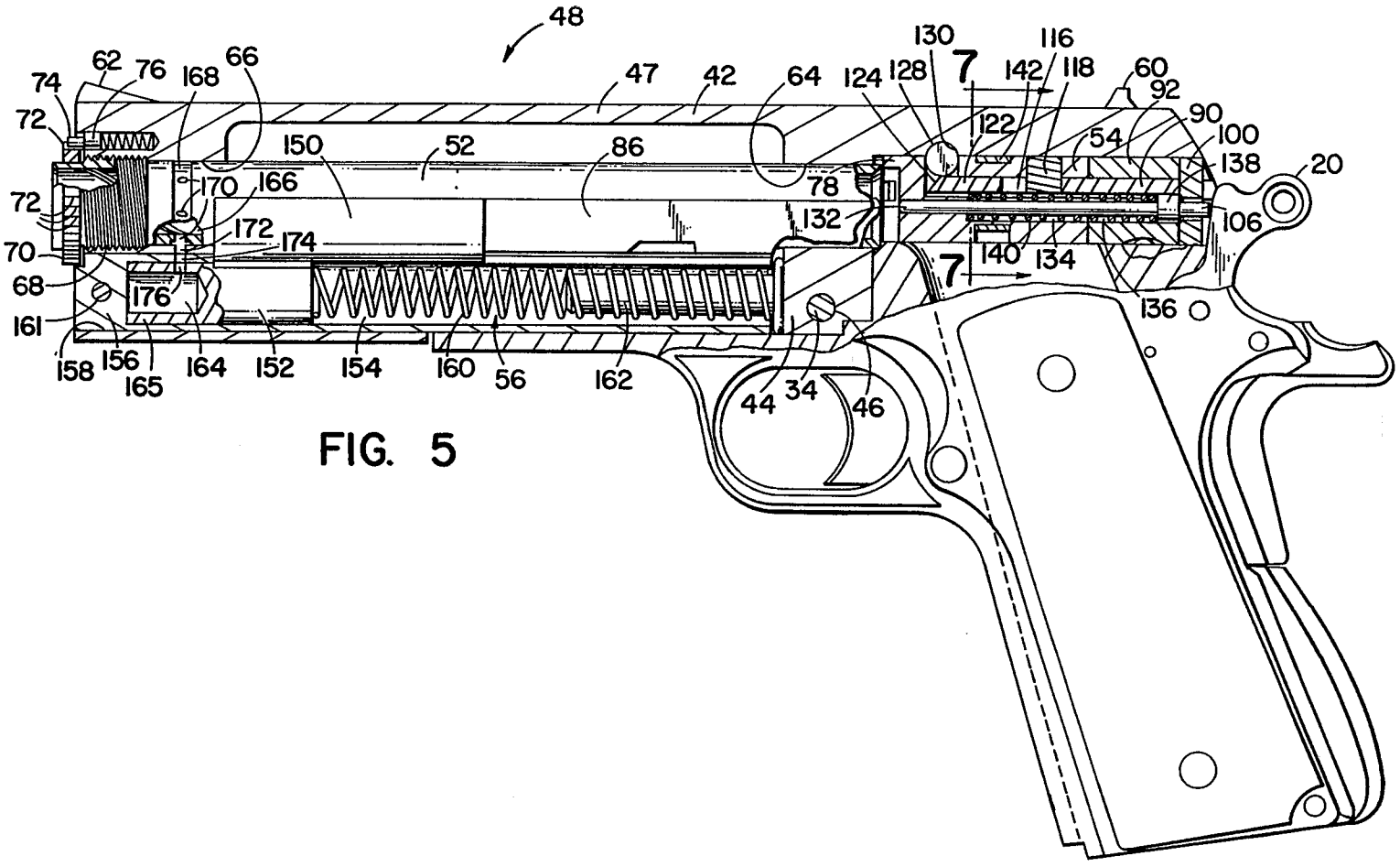
FIG. 5 is an enlarged view partly in elevation and partly in vertical section of the pistol of FIG. 4.

Referring to FIG. 5, the barrel 52 is supported at both of its ends by the shroud 47; at its rear end being rotatably supported with a close fit in the bore 64 of an adjacent portion of the shroud, and at its forward end being received in a forward opening 66 of the shroud. At the forward portion of this opening 66 both the opening 66 and the barrel are threaded as indicated at 68, and rearwardly of the threads 68 the barrel and shroud bore 66 have a close rotatable fit relative to one another. Therefore, the barrel through the threads 68 and engagement with the shroud bores 64 and 66 is rigidly fixed to the shroud 47 so as to be immovable relative to it during repeated firings. However, the barrel may be manually adjusted relative to the shroud, by threading it into or out of the shroud to adjust the spacing between the rear end of the barrel and the forward face of the bolt. On the forward end of the barrel, and integral with it, is a ring 70 having a plurality of grooves 72 running parallel to the barrel axis and spaced circumferentially from one another any one of which may be positioned to receive a finger 74 on the outer end of a spring biased plunger 76 carried by the shroud with the engagement of the finger 74 with one of the grooves 72 serving to hold the barrel in its given angular position relative to the shroud. Therefore, to make an adjustment of the barrel relative to the shroud the plunger 76 is pushed rearwardly by hand or using a simple tool to free the finger 74 from holding engagement with the ring 70, and then the barrel may be rotated to bring it to the desired adjustment relative to the shroud at which time the plunger is released to return the plunger 76 to the position at which the finger reengages a groove 22 in the ring to hold the barrel in the newly selected position.

Figure 6:
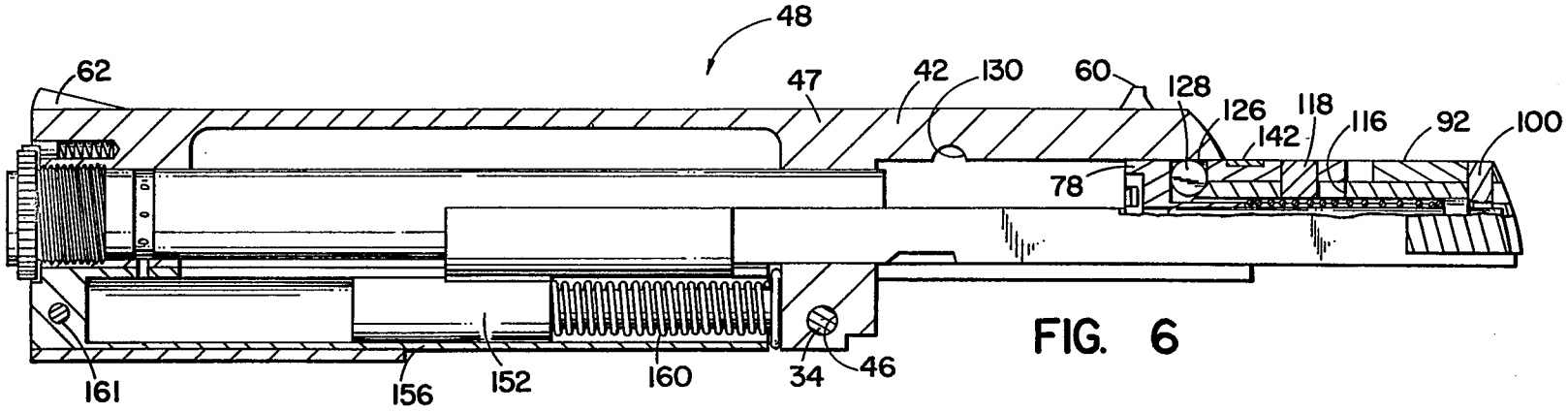
FIG. 6 is a view similar to FIG. 5 but showing the piston and bolt of the firearm in their rearwardmost positions, the receiver being omitted in this view.
Figure 8:
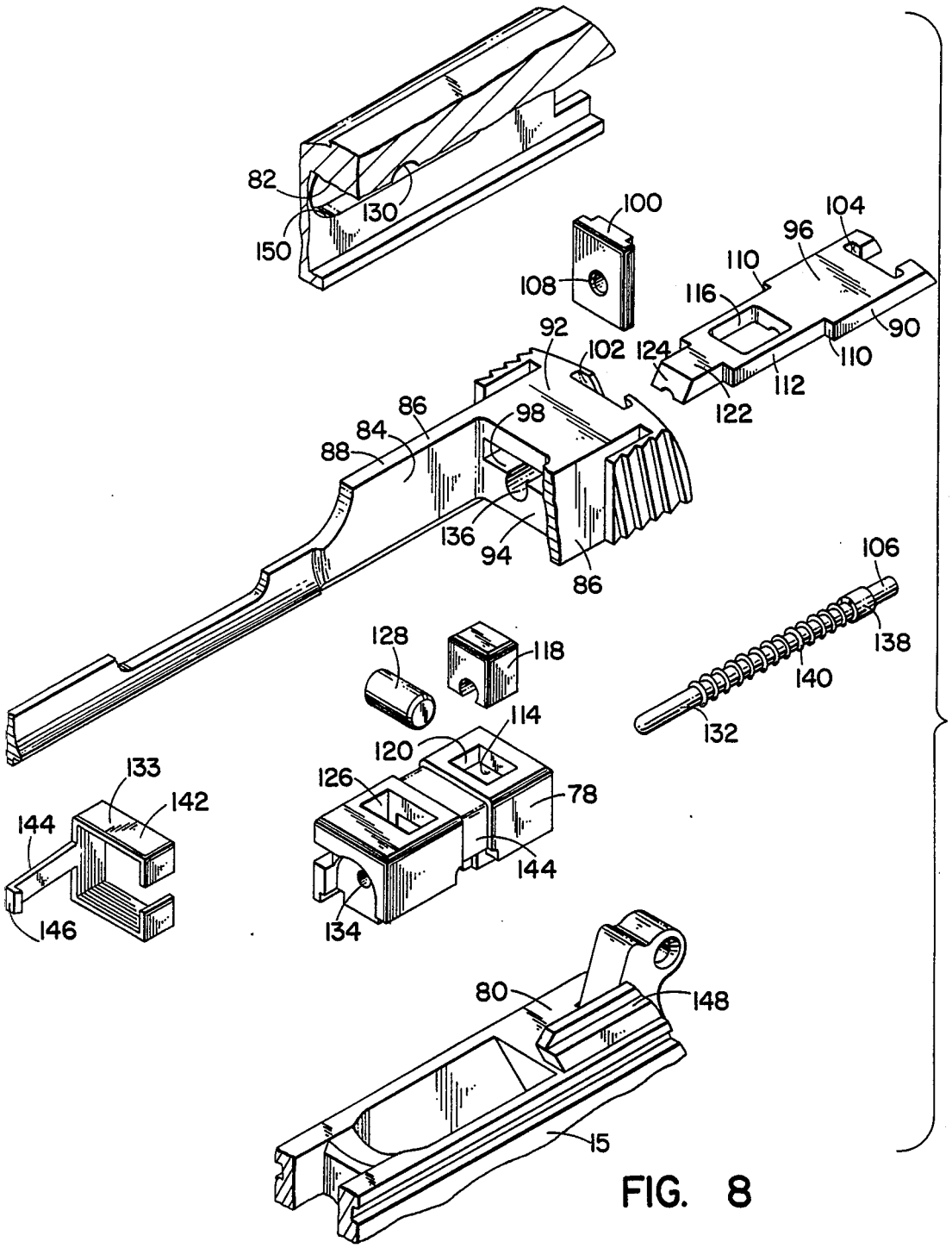
FIG. 8 is an exploded perspective view of the bolt, and its associated parts, of the firearm of FIG. 4.

Turning next to the construction of the bolt 54 and referring first to FIG. 8, the bolt includes a bolt member 78 supported for sliding movement relative to the receiver and shroud between a forward position, shown in FIG. 5, at which it is closed relative to the barrel, and a rearward position shown in FIG. 6 at which it is open relative to the barrel. In transverse cross section the bolt member 78 is of essentially rectangular shape and for its sliding movement it is supported on its bottom face by engagement with the top surface 80 of the receiver frame 15, on its top surface by engagement with a surface 82 of the shroud and on its sides by engagement of each of its side faces with an adjacent face 84 provided by an adjacent one of two operating side arms 86, 86 of a slide 88 between which arms 86, 86 the bolt member 78 is received. A bolt operating member 90 is fixed to the rear end portion 92 of the slide 88 and extends forwardly from the forward face 94 of such rear end portion into sliding engagement with the bolt member 78. That is, for its mounting to the slide 88 the bolt operating member 90 has a rear portion 96 which fits into and through a conforming opening 98 in the rear slide portion 92 and it is held to the slide by a retainer or key 100 inserted vertically into a vertically extending conforming groove 102 on the slide and matching groove 104 in the member 90 with the retainer 100 being vertically held in place by the rear end 106 of the firing pin which in the assembled condition of the parts extends through a hole 108 in the retainer.

The rear portion 96 of the bolt operating member terminates at two shoulders 110, 110 which in the assembled condition of the bolt operating member 90 with the slide 88 align with the slide surface 94. Forwardly of the rear portion 96 the bolt operating member 90 has an intermediate portion 112 slidably received in a conforming recess 114 in the bolt member 78. The portion 112 is pierced by a somewhat elongated slot 116 which receives a rectangular pin 118 located in a vertically extending recess 120 in the bolt member 78 communicating with the top surface of the bolt member and with the recess 114. In the front to rear dimensions the slot 116 is longer than the pin 118 so that together the slot 116 and pin 118 provide a lost motion connection between the operating member 90 and the bolt member 78 permitting the operating member to move a small distance relative to the bolt member in the forward to rear direction and limiting the extent of such movement. FIG. 5 shows the operating member 90 in the forward limit of its movement relative to the bolt member 78, at which the pin 118 engages the rear end of the slot, while FIG. 6 shows it in its rearward limit at which the pin 118 engages the forward end of the slot 116.

The bolt operating member 90 also includes a forward portion 122, with a forward inclined cam surface 124, which in part resides in another vertically extending recess 126 in the bolt member 78 when the operating member is in its forward position reltive to the bolt member. The recess 126 also receives a cylindrical locking roller 128 which further cooperates with a complementary locking recess 130 in the shroud. That is, the locking roller 128 has a cylindrical surface of revolution and the recess 130 has a surface matching or conforming to that of the roller.

FIG. 5 shows the bolt member 78 in its forwardmost position with the locking roller 128 in locking engagement with the locking recess 130. The locking roller is held in this locked position by the cam surface 124 on the forward portion 122 of the operating member 90 which member at this time is also in its forwardmost position relative to the bolt member 78.

FIG. 6 shows the bolt member 78 moved to its rearwardmost position relative to the shroud and to get to this position the locking roller 128 must first be moved from its locked or FIG. 5 position to a released position before the rearward movement of the bolt member can take place. The sequence of steps in moving from the FIG. 5 condition to the FIG. 6 condition is as follows. In the FIG. 5 condition the slide 88 is in its forwardmost position relative to the shroud. The bolt member is in its forwardmost position relative to the shroud and the bolt operating member is in its forwardmost position relative to the bolt member in which the cam surface 124 holds the locking roller 128 in the locking recess to prevent rearward movement of the bolt member. Upon the firing of a cartridge, as explained in more detail hereinafter, the slide 88 moves rearwardly and takes with it the bolt operating member 90 while the bolt member initially remains stationary relative to the shroud. Therefore, the operating member moves rearwardly relative to the bolt member moving the cam surface 124 away from the locking roller 128 and allowing the locking roller to drop downwardly into the recess 126 freeing it from the locking recess 130 of the shroud. At substantially the same time as the locking roller 128 is freed for movement from the locking recess 130 further rearward movement of the bolt operating member 90 relative to the bolt member 78 is prevented by engagement of the forward end of the slot 116 with the pin 118. Thus, as the slide continues in its rearward movement the bolt member 78 thereafter travels with the slide until the position of FIG. 6 is achieved (which is determined by engagement of the piston with a stop as hereinafter described). Thereafter the reverse sequence of events takes place as the slide moves forwardly returning the parts from their FIG. 6 positions to their FIG. 5 positions. That is, during the forward movement of the slide the slide, bolt operating member and bolt member first move in unison until the bolt member reaches the forward limit of its movement at which the locking roller 128 becomes aligned with the locking recess 130. Thereafter, further continued forward movement of the slide moves the operating member forwardly relative to the bolt, while the bolt remains stationary relative to the shroud, causing the camming surface 124 of the operating member 90 to move the locking roller upwardly into the recess 130 thereby again locking the bolt member against movement relative to the shroud.

In addition to the locking means, as described above, the bolt member 78 also carries a firing pin 132 and an extractor 133, FIG. 8. The firing pin 132, as best seen in FIG. 5, resides in an elongated recess 134 extending through the bolt member and another part of it is received in a recess 136 extending through the rear end portion of the slide. As previously mentioned, the rear end portion 106 of the firing pin extends through the opening 108 in the key 100. Forwardly of this rear end portion 106 is an enlarged diameter portion 138 providing a rear annular shoulder engageable with the key 100 to limit the rearward movement of the firing pin. The firing pin is further normally positioned in this rearwardly limited position by a helical spring 140 surrounding it and extending between a forward shoulder provided by the bolt member 78 and the forward shoulder of the enlarged diameter portion 138. It will thereafter also be evident that the spring 140 tends to urge the bolt member 78 forwardly relative to the slide 92.

Figure 7:
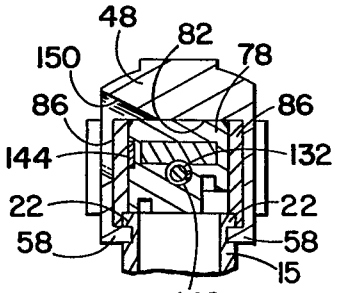
FIG. 7 is a transverse sectional view taken on the line 7—7 of FIG. 5.

The extractor 133 is made of spring metal and has a rear portion 142 which snaps around a reduced section portion 144 of the bolt member 78. An arm portion 144 extends forwardly from the rear portion 142 and is received in a slot in the left side of the bolt member 78 as seen in FIG. 7. At the forward end of the arm 144 is a finger 146 engageable with the rim of a shell to pull it from the barrel chamber as the bolt moves rearwardly. An ejector 148 on the receiver frame engages the withdrawn shell causing it to be ejected through an ejection port 150 in the shroud as the bolt reaches its rearwardmost position.

The aforementioned slide 88 is part of a gas activated piston means for operating the bolt. The two transversely spaced longitudinally extending side arms 86, 86 of the slide are slidably supported within the shroud on opposite sides of the barrel 52. At their forward ends the two side arms 86, 86 are connected together by a part 150 of the slide which is U-shaped and passes beneath the barrel 52. The part 150 in turn is connected to a piston 152 which extends forwardly from it and is received in a piston chamber 154 extending longitudinally along an axis parallel to and spaced below the axis of the barrel 52, the piston 152 and piston chamber 154 being of corresponding circular cross sectional shapes so that the piston is slidable forwardly and rearwardly in the chamber 154 with a reasonably close fit. The piston chamber 154 is provided by a separate part 156 received in a bore 158 of the shroud and fixed to the shroud by a transversely extending bolt or pin 161.

The piston as shown in FIG. 5 is in its forwardmost position at which position further forward movement is stopped by engagement of the forward face 94 of the slide portion 92 with the rear end of the bolt member 78, and the piston is resiliently held in this position by a return spring 160 received in the piston chamber 154 rearwardly of the piston and having its rear end portion received on a guide and stop member 162 attached to the lug 44. From the position shown in FIG. 5 the piston 152 is movable rearwardly against the force of the spring 160 with such rearward movement being limited by engagement of the rear face of the piston 152 with the forward end of the guide and stop member 162.

The forward portion of the piston 152 is hollow by virtue of its containing a cylindrical cavity 164 communicating with the forward end of the piston and extending rearwardly for some distance from that end to a rear cavity end spaced from the rear or right-hand end of the piston 152, the rear end of the cavity therefore being closed with respect to the rear end of the piston and the cavity providing the forward portion of the piston with an annular sidewall 165.

A gas passageway is provided for flow of high pressure gas from the bore 166 of the barrel 52 to the piston chamber 154 for activating the piston 152 with such passageway more particularly communicating with the piston cavity 164 when the piston is in its forwardmost position. In the illustrated case the passageway means includes an annular groove 168 on the outside of the barrel 52 communicating with a number of orifices 170 extending between the bottom of the groove 168 and the barrel bore 166. The annular groove 168 is positioned in turn so as to be aligned with an opening 172 in the shroud, an opening 174 in the part 156 and a port 176 in the annular wall 165 of the piston. At the instant a cartridge is fired the piston 152 is located in the forward position of FIG. 5. Immediately after the bullet passes the orifices 170, 170 high pressure gas existing in the barrel bore passes through the openings 172 and 174 and port 176 into the cavity 164 and rapidly builds up to a pressure at which the piston 152 moves rearwardly against the return spring 160. As soon as the piston 152 starts its rearward movement the piston port 176 is moved out of alignment with the opening 174 thereby cutting off further flow of pressurized gas to the cavity 164. In this way the pressure applied to the piston is limited and cartridges of different sized loads may be fired without any adjustments having to be made to accommodate the load differences. By the time the forward end of the piston reaches the opening 174 the bullet has left the barrel bore and the pressure in the barrel bore will have fallen off to a low value so that it will not then add further significant impulse, if any, to the piston. Instead, the high pressure initially trapped in the cavity 164 and forward part of the piston chamber will now exhaust outwardly through the openings 174, 172 and 170 and through the barrel bore. In any event, the pressure impulse applied to the piston 152 is sufficient to move it rearwardly for a full stroke at the end of which it engages the guide and stop 162, and thereafter the spring 160 returns it to its forward position, whereby the slide moves with the piston and executes a full rearward and forward stroke operating the bolt and its locking means in the way previously described.

I claim:

1. A unit for use in converting a blowback autoloading pistol of the type having a receiver with a firing mechanism including a hammer, a barrel and a slide into a gas piston operated one, said unit being intended for connection to said receiver after said barrel and slide are removed therefrom, said unit comprising a shroud, a barrel carried by said shroud and immovable relative to said shroud during successive firings of said gas operated pistol, a gas piston operated bolt including a firing pin and supported by said shroud for movement between open and closed positions relative to said barrel, and means for connecting said shroud to said receiver so that said shroud is immovable relative to said receiver during successive firings of said gas operated pistol and so that said hammer can activate said firing pin to fire said gas operated pistol when said bolt is in said closed position.

2. A unit for use with a blowback autoloading pistol of the type consisting of a receiver, a barrel connected with said receiver, and a slide slidably supported on said receiver, said receiver containing a trigger and firing mechanism and a cartridge magazine and forming a hand grip, said slide containing a bolt with a firing pin, and said receiver and slide having cooperating sets of guide surfaces for restraining said slide to longitudinal sliding movement relative to said receiver, said unit being intended for use in converting such blowback autoloading pistol into a gas operated pistol by being connected to said receiver after said barrel and slide are removed therefrom, said unit comprising a shroud, a barrel carried by said shroud and immovable relative to said shroud during successive firings of said gas operated pistol, a gas piston operated bolt carried by said shroud and movable relative to said shroud between open and closed positions with respect to said barrel during successive firings of said gas operated pistol, and means for connecting said unit to said receiver which connecting means includes a set of guide surfaces cooperable with said set of guide surfaces on said receiver to restrain said unit to longitudinal sliding movement relative to said receiver during assemble therewith, and means for holding said unit in a given assembled position along its path of such longitudinal sliding movement relative to said receiver to render said shroud immovable relative to said receiver during successive firings of said gas operated pistol.

3. A unit for use with a blowback autoloading pistol as defined in claim 2 further characterized by said shroud including a piston chamber extending along an axis generally parallel to the longitudinal axis of said barrel, a piston slidable in said piston chamber between forward and rear positions, a spring means urging said piston forwardly toward its said forward position, means providing a gas passageway extending between the bore of said barrel and said piston chamber so that upon firing of a cartridge high pressure gas appearing in said barrel bore is applied to said piston to move it rearwardly against the force of said spring means with said spring means thereafter returning said piston to its said forward position, and mechanical drive means connected between said piston and said bolt for operating said bolt in response to movement of said piston.

4. A unit for use in converting a blowback autoloading pistol, such as a U.S. caliber .45 model 1911A1, into a gas operated pistol, said unit being adapted to be connected with the receiver of said blowback pistol after its barrel, its slide and the components contained in said slide are removed from the receiver, said unit when so connected with said receiver generally replacing said barrel, said slide, and the components contained in said slide, of said blowback pistol, to form in combination with said receiver a gas operated pistol, said unit comprising a shroud, a barrel carried by said shroud and having forward and rear ends, means connecting said barrel to said shroud so that said barrel is immovable relative to said shroud during successive firings of said gas operated pistol, a bolt slidably supported by said shroud for movement between closed and open positions relative to said rear end of said barrel, said bolt having a forward end which in said closed position of said bolt is located near said rear end of said barrel and which in said open position of said bolt is located further from said rear end of said barrel, means for locking said bolt in its said closed position relative to said shroud and movable between an active condition in which said bolt is held against movement from said closed position and a release condition at which said bolt is free to move relative to said shroud, means providing a piston chamber extending along an axis generally parallel to the longitudinal axis of said barrel, a piston slidable in said piston chamber between forward and rear positions and having a forward end and a rear end, a spring means urging said piston forwardly toward its said forward position, means providing a gas passageway extending between the bore of said barrel and said piston chamber adjacent the forward end of said piston when said piston is in its forward position so that upon firing of a cartridge high pressure gas appearing in said barrel bore is applied to said forward end of said piston driving said piston rearwardly from its said forward position to its said rearward position against the force of said spring means with said spring means thereafter returning said piston to its said forward position, and mechanical drive means connected between said piston and said bolt and said locking means for producing such operation of said bolt and said locking means that as said piston moves rearwardly from said forward position to said rear position during a first part of said rearward piston movement said locking means is moved from its locked to its released condition and during the remainder of said rearward piston movement said bolt is moved from its forward to its rearward position and as said piston moves forwardly from said rear to said forward position during a first part of said forward piston movement said bolt is moved from its rear to its forward position and during the remainder of said forward piston movement said locking means is moved from said released to said locked condition.

5. A unit as defined in claim 4 for use in converting a blowback autoloading pistol of the type having a receiver with a set of longitudinally extending guide surfaces which cooperate with corresponding longitudinal guide surfaces on its slide to restrain said slide to longitudinal sliding movement relative to said receiver and wherein the barrel in said slide is pivotally connected to said receiver by means of a removable pin passing transversely through said receiver and through a link connected with said barrel so that said slide and said barrel and other components contained in said slide may be removed from said receiver by first removing said pin from said receiver and then sliding said slide longitudinally from said receiver, said shroud having a set of longitudinal guide surfaces corresponding with those of said receiver slidably supporting said shroud for movement from a position at which said shroud is removed from said receiver to a fully assembled position of said shroud relative to said receiver, said shroud having means defining an opening registering with the openings in said receiver for said removable pin after said shroud is moved onto said receiver to said fully assembled position so that said locking pin may be inserted through said receiver and shroud openings to restrain said shroud against sliding movement relative to said receiver to thereby hold said shroud in said fully assembled position and immovable relative to said receiver during successive firings of said gas operated pistol.

6. A unit as defined in claim 4 further characterized by said means for locking said bolt in its closed position including a locking member carried by said bolt and means defining a locking recess in said shroud, said locking member being movable relative to said bolt in a direction perpendicular to the path of movement of said bolt between a locking position at which it extends into said locking recess and locks said bolt against movement relative to said shroud and a released position at which it is free of said locking recess and releases said bolt for movement relative to said shroud, an operating member slidably engaged with said bolt, said operating member having a cam surface engageable with said locking member and being movable relative to said bolt between a forward position at which said cam surface positions said locking member in said locked position and a rearward position at which said cam surface allows said locking membr to move to said released position, and said mechanical drive means connected between said piston and said bolt comprising means directly mechanically connecting said operating member with said piston so that said operating member and said piston move in unison with one another.

7. A unit as defined in claim 6 further characterized by means limiting said sliding movement of said operating member relative to said bolt which means is so arranged that with said bolt in said forward position and said locking element in said locked position upon rearward movement of said operating member relative to said shroud said operating member first moves rearwardly relative to said bolt while said bolt remains stationary relative to said shroud, allowing said locking element to move to its released position, and then said operating member abuts said bolt to cause said bolt to move rearwardly relative to said shroud along with said operating member to move said bolt from said closed to said open position.

8. A unit as defined in claim 7 further characterized by said locking element being a roller having a surface of revolution about an axis perpendicular to the path of movement of said bolt relative to said shroud, and said locking recess of said shroud having a surface conforming generally to that of said roller surface of revolution.

9. A gas operated autoloading firearm comprising a frame, a barrel supported by said frame, a bolt supported on said frame for movement relative to said frame in a direction parallel to the longitudinal axis of said barrel between a closed forward position and an open rearward postion relative to said barrel, means for locking said bolt in said closed position including a locking member carried by said bolt and a locking recess in said frame, said locking member being movable relative to said bolt in a direction generally perpendicular to the path of movement of said bolt between a locking position at which it extends into said locking recess and locks said bolt against movement relative to said frame and a released position at which it is free of said locking recess and releases said bolt from movement relative to said frame, means defining a piston chamber extending along an axis generally parallel to said longitudinal axis of said barrel, a piston slidable in said piston chamber between forward and rear positions, a spring means urging said piston forwardly toward its forward position, means providing a gas passageway between the bore of said barrel and said piston chamber so that upon the firing of a cartridge high pressure gas appearing in said barrel bore is applied to said piston to move it rearwardly against the force of said spring means with said spring means thereafter returning said piston to said forward position, and mechanical drive means connected between said piston and said bolt for operating both said bolt and said locking means in response to movement of said piston.

10. A firearm as defined in claim 9 further characterized by an operating member slidably engaged with said bolt, said bolt operating member having a cam surface engageable with said locking member and being movable relative to said bolt between a forward position at which said cam surface positions said locking member in said locked position and a rearward position at which said cam surface allows said locking member to move to said release position, and said mechanical drive means connected between said piston and said bolt comprising means directly mechanically connecting said operating member with said piston so that said operating member and said piston move in unison with one another.

11. A firearm as defined in claim 10 further characterized by means limiting said sliding movement of said operating member relative to said bolt which means is so arranged that with said bolt in said forward position and said locking element in said locked position upon rearward movement of said operating member relative to said frame said operating member first moves rearwardly relative to said bolt while said bolt remains stationary relative to said frame allowing said locking element to move to its released position, and the said operating member abuts said bolt to cause said bolt to move rearwardly relative to said frame along with said operating member to move said bolt from said closed to said open position.

12. A firearm as defined in claim 11 further characterized by said member being a roller having a surface of revolution about an axis perpendicular to the path of movement of said bolt relative to said frame, and said locking recess of said frame being a surface conforming generally to that of said roller surface of revolution.

* * * * *